US009266131B2

(12) United States Patent
Ogawa et al.

(10) Patent No.: US 9,266,131 B2
(45) Date of Patent: Feb. 23, 2016

(54) PUMP-EQUIPPED CONTAINER AND DISPENSING PUMP USED FOR SAME

(75) Inventors: Yukihiro Ogawa, Ibaraki (JP); Satoshi Miyatake, Ibaraki (JP); Takuya Tsuji, Amagasaki (JP); Tayori Kato, Amagasaki (JP); Kenji Tanaka, Amagasaki (JP)

(73) Assignee: NIHON YAMAMURA GLASS CO., LTD., Amagasaki-shi (JP)

( * ) Notice: Subject to any disclaimer, the term of this patent is extended or adjusted under 35 U.S.C. 154(b) by 106 days.

(21) Appl. No.: 13/985,134

(22) PCT Filed: Feb. 14, 2012

(86) PCT No.: PCT/JP2012/053408

§ 371 (c)(1), (2), (4) Date: Oct. 9, 2013

(87) PCT Pub. No.: WO2012/111670

PCT Pub. Date: Aug. 23, 2012

(65) Prior Publication Data

US 2014/0190996 A1 Jul. 10, 2014

(30) Foreign Application Priority Data

Feb. 17, 2011 (JP) ..... 2011-032283

(51) Int. Cl.

| | |
|---|---|
| ***B67D 7/58*** | (2010.01) |
| ***B05B 11/00*** | (2006.01) |
| ***B05B 15/00*** | (2006.01) |

(52) U.S. Cl.

CPC ..... *B05B 11/0037* (2013.01); *B05B 11/3047* (2013.01); *B05B 15/005* (2013.01)

(58) Field of Classification Search

CPC ..... B05B 15/005; B05B 11/0037; B05B 11/3042; B05B 11/3047; B05B 11/30; B05B 11/3012; B05B 11/3014; B05B 11/3028

USPC ..... 222/189.1, 321.7–321.9, 382, 383.1, 222/464.1–464.6, 464.7

See application file for complete search history.

(56) References Cited

U.S. PATENT DOCUMENTS

2005/0026761 A1* 2/2005 Wilkes ..... 493/87

FOREIGN PATENT DOCUMENTS

JP 2001-213489 * 8/2001 ..... B65D 83/76

* cited by examiner

*Primary Examiner* — Frederick C Nicolas
*Assistant Examiner* — Bob Zadeh
(74) *Attorney, Agent, or Firm* — Kratz, Quintos & Hanson, LLP

(57) ABSTRACT

A pump-equipped container and a dispensing pump used therefor are provided, such that a thin container body can be implemented, while deformation of the container body associated with an operation portion being pushed down can effectively be prevented. A pump-equipped container 1 includes: a container body 2 having a mouth portion 15; and a dispensing pump 20 removably attached to the mouth portion 15. The dispensing pump 20 includes: a pump body 22 removably attached to the mouth portion 15 of the container body 2; a support member 31 having its bottom end portion abutted on a bottom portion 5 of the container body 2 to thereby receive a downward load acting on the mouth portion 15 of the container body 2; a leg member 32 provided at the support member 31.

6 Claims, 14 Drawing Sheets

(a)

(b)

(a)

(b)

PUMP-EQUIPPED CONTAINER AND DISPENSING PUMP USED FOR SAME

TECHNICAL FIELD

The present invention relates to a pump-equipped container suitable for a container which can be crushed by hands to achieve a reduction in volume, and to a dispenser pump used therefor.

BACKGROUND ART

As a container that stores a liquid material such as shampoo, hair conditioner, hand soap or the like such that the liquid material can be dispensed, what is widely employed is a pump-equipped container that includes: a container body having a mouth portion; and a manual dispenser pump that is removably attached to the mouth portion. A push-down operation applied to an operation portion of the dispenser pump projecting upwardly from the container body allows the content stored in the container body to be discharged from a dispenser nozzle provided at the operation portion.

Normally, the container body of the pump-equipped container is structured to have enough strength and stiffness so as not to easily be crushed by hands at least. After the content is finished up, the dispenser pump is removed from the mouth portion of the container body, and the container body is charged with the content from a refill pouch, so that the dispenser pump and the container body can repeatedly be used. However, when the container body is to be refilled with the content, the content must be poured into the mouth portion of the container body while the soft pouch is held in hand in a state where the empty container body is placed on the floor or the like. Such work takes time and is very troublesome. Furthermore, sometimes the position of the container body and that of the pouch are displaced from each other, resulting in spilling of the content. Therefore, there has been a great demand of the user for simplification of refilling work.

Accordingly, what is also proposed is a pump-equipped container, in which a thin container body that can be crushed by hands to achieve a reduction in volume is employed as the container body. When the content is finished up, the dispenser pump is removed from the container body to be attached to the refill container body filled with the content. The empty container body is crushed and discarded (e.g., see Patent Documents 1 and 2).

Meanwhile, in the case where a thin container body such as described above is used, in order to prevent the container body from being damaged by the push-down operation force that occurs when the operation portion is pushed downwardly to discharge the content, it is necessary to provide a support structure that receives the pushdown operation force of the operation portion.

As the support structure, Patent Document 1 discloses a support structure in which: a suction pipe of a dispenser pump having the strength and stiffness enough to receive the push-down operation force of the operation portion is used; a support element that abuts on the bottom portion of the container body is rotatably provided at the bottom end portion of the suction pipe; and the push-down operation force of the operation portion is received by the support element and the suction pipe. Further, Patent Document 2 discloses a support structure which is provided with a support pipe externally provided to a suction pipe; the bottom portion of the support pipe is branched into three to form three leg portions; the bottom end portion of each of the three leg portions is allowed to abut on the bottom face of the container body, whereby the push-down operation force of the operation portion is received by the support pipe.

On the other hand, what is proposed is a mouth member-equipped container as a container that stores jelly-like food, including a rectangular parallelepiped-shape soft container body having gusset portions, the gusset portions being provided at a pair of side faces opposing to each other and capable of being folded inwardly (e.g., see Patent Document 3).

CITATION LIST

Patent Literatures

Patent Document 1: JP-A No. 2004-149199
Patent Document 2: JP-A No. 2001-213489
Patent Document 3: JP-A No. 2010-269601

SUMMARY OF INVENTION

Technical Problem

According to the invention disclosed in Patent Document 1, since the support element is rotatably provided at the bottom end portion of the suction pipe, when the operation portion is pushed down in the vertical direction, the push-down operation force of the operation portion can effectively be received by the suction pipe and the support element. However, when the operation portion is diagonally pushed down, a problem arises, i.e., the support element rotates and part of the push-down operation force of the operation portion acts on the container body, whereby the container body deforms. Further, according to the invention disclosed in Patent Document 1, there also exists a problem that the bottom end portion of the suction pipe becomes higher by the height of the support element, and the content packed in the container body cannot completely be suctioned.

On the other hand, according to the invention disclosed in Patent Document 2, even when the operation portion is pushed diagonally downwardly, the leg portions elastically deform so as to receive the push-down force acting on the operation portion, similarly to the case where the operation portion is pushed down in the vertical direction. However, since the operation force is received by the elastic deformation of the leg portions, there exists a problem that a greater force is applied to the container body when the operation force becomes great, whereby the container body deforms. Further, according to the invention disclosed in Patent Document 2, when the dispenser pump is removed from the container body, the plurality of leg portions naturally converge by being brought into contact with the mouth portion of the container body. However, when the dispenser pump is attached to the container body, the plurality of leg portions must be maintained in the converged state by one hand, and in this state, the bottom end portions of the plurality of leg portions must simultaneously be inserted into the mouth portion of the container body. Accordingly, there also exists a problem that assembling work of the dispenser pump becomes very troublesome.

An object of the present invention is to provide a pump-equipped container and a dispenser pump used therefor, with which an operation force attributed to an operation portion of a dispenser pump being pushed downwardly is prevented from acting on a container body as much as possible, and with which deformation of the container body can effectively be prevented while a thin container body capable of achieving a reduction in volume is implemented.

Solution to Problem

A pump-equipped container of the present invention includes: a container body having a mouth portion; and a dispenser pump removably attached to the mouth portion, wherein the dispenser pump includes: a pump body that has an operation portion capable of reciprocating in a top-bottom direction and that is removably attached to the mouth portion of the container body; a support member having its bottom end portion abutted on a bottom portion of the container body to thereby receive a downward load acting on the mouth portion of the container body; and a leg member provided at the support member so as to be capable of switching between a closed-leg attitude in which the leg member can pass through the mouth portion and an open-leg attitude in which the leg member spreads outwardly in a radial direction of the support member, the leg member in the open-leg attitude abutting on the bottom portion of the container body to thereby receive a diagonally downward load acting on the mouth portion of the container body.

With the pump-equipped container, the dispenser pump can be attached to or removed from the container body with the leg member switched to the closed-leg attitude. Further, the operation portion is pushed down to dispense the content in the state where the dispenser pump is attached to the container body with the leg member switched to the open-leg attitude. Here, the bottom end portion of the support member and the bottom end portion of the leg member abut on the bottom portion of the container body, whereby the push-down operation force of the operation portion is received by the support member and the leg member and the push-down operation force acts on the container body very little. In this manner, in the present invention, since the push-down operation force of the operation portion is received by the support member and the leg member, the push-down operation force of the operation portion can effectively be received in both the cases where the operation portion is pushed down in the vertical direction and where the operation portion is diagonally pushed down. It is to be noted that, in the case where the operation portion is pushed down, the push-down operation force of the operation portion may solely be received by the support member, or it may be received by cooperation of the support member and the leg member. Further, when the operation portion is diagonally pushed down, the push-down operation force of the operation portion is received by cooperation of the operation member and the leg member.

Thus, with the pump-equipped container, since the push-down operation force of the operation portion can be received by the support member and the leg member, it becomes possible to employ a thinner and softer container body as the container body as compared to a conventional container body, and to reduce the material of the container body as much as possible. Further, even in the case where the refill content is replaced together with the container body so as to eliminate the content refill work through use of a pouch, waste attributed to such a disposable container body can be suppressed to minimum possible. Further, since the container body can be crushed, a reduction in waste volume can also be achieved.

Here, another preferable mode is the pump-equipped container in which the leg member is a plurality of leg portions that can elastically deform over the open-leg attitude being a natural state in which the leg portions extend diagonally downwardly from an intermediate portion in a height direction of the support member and the closed-leg attitude in which the leg portions extend along the support member. In this case, in the situation where the dispenser pump is to be attached to the container body, the leg portions are elastically deformed by the narrowing ring to be in the closed-leg attitude and the bottom end portion of the leg member in this state is inserted into the mouth portion of the container body. After the bottom end portions of the leg portions are inserted into the mouth portion of the container body, by the dispenser pump being inserted into the container body as it is, the attitude of the leg portions is automatically switched to the open-leg attitude by the elasticity of the leg portions. On the other hand, in the situation where the dispenser pump is to be removed from the container body, shifting the dispenser pump upwardly as it is relative to the container body, the leg portions automatically elastically deform to be in the closed-leg attitude by abutting on the mouth portion of the container body. Thus, the dispenser pump can be removed from the container body.

Still another preferable mode is the pump-equipped container in which the support member is structured as being divided into a top support member and a bottom support member, and the leg portions are integrally provided to a bottom end portion of the top support member. Though it is possible to structure the leg portions and the support member as separate members and to connect the leg portions to the support member, such a structure complicates the connecting structure and an expensive molding assembly for molding each leg portion is required. Therefore, as in the present invention, the support member is structured as being divided into the top support member and the bottom support member, and the leg portions are integrally provided to the top support member. Thus, the leg portions can be provided to the support member while an increase in the number of components or a complicated mold assembly structure is avoided.

Further, as described above, in the case where the leg member is a plurality of leg portions that can elastically deform, still another preferable mode is the pump-equipped container that further includes a narrowing ring shiftable along the support member. An operation of the narrowing ring can switch the leg portions between the open-leg attitude and the closed-leg attitude. Further, in such a structure, other preferable modes are: provision of an engaging stopper projecting portion that engagingly stops shifting of the narrowing ring from the mouth portion into the container body, the engaging stopper projecting portion being formed at the mouth portion of the container body; provision of a restricting projecting portion that restricts a lowermost position of the narrowing ring relative to the support member, the restricting projecting portion being formed at each of the leg portions; provision of a receiving projecting portion to at least one of the support member and the leg portions, the receiving projecting portion abutting on other one of the support member and the leg portions to receive elastic deformation of the leg portions toward the support member than the closed-leg attitude, and the receiving projecting portion being formed so as to correspond to a height position of the restricting projecting portion in the closed-leg attitude; provision of a pop-up suppressing portion that suppresses the narrowing ring maintained at the lowermost position from popping up, the pop-up suppressing portion being formed projectively outwardly at an intermediate portion in a height direction of each of the leg portions; provision of a holding projecting portion that holds the narrowing ring in the mouth portion of the container body, the holding projecting portion being formed at the mouth portion of the container body; provision of an abutment portion capable of being brought into surface contact with the bottom portion of the container body, the abutment portion being formed at a bottom end portion of each of the leg portions; and arrangement of the bottom end portion of each of the leg portions at an outer circumferential portion of the bottom portion of the container body.

When the narrowing ring as described above is provided, downward operation of the narrowing ring so as to externally be fitted to the bottom end portions of the leg portions allows a plurality of leg portions to simultaneously be switched to the closed-leg attitude. Therefore, in the situation where the dispenser pump is to be attached to the container body, the troublesome work of elastically deforming the leg portions in the closed-leg attitude by hand and inserting the bottom end portions of the leg portions into the mouth portion of the container body can be eliminated, whereby the attaching work of the dispenser pump to the container body can greatly be simplified. Further, with the engaging stopper projecting portion provided at the mouth portion, in the situation where the leg portions are inserted into the mouth portion in order to attach the dispenser pump to the container body, the narrowing ring externally fitted to the leg portions is engagingly stopped by the mouth portion, whereby the leg portions are automatically switched to the open-leg attitude. Further, with the restricting projecting portion provided at each of the leg portions, the restricting projecting portion can prevent the narrowing ring from coming off from the leg portions. Therefore, when the narrowing ring is shifted toward the closed-leg attitude side, it becomes possible to prevent the narrowing ring from coming off from the leg portions. Further, with the receiving projecting portion being formed, the leg portions are prevented from elastically deforming toward the support member side than in the closed-leg attitude in the state where the narrowing ring is shifted to the lowermost position. Therefore, the position of the narrowing ring can be restricted to the lowermost position while having the restricting projecting portion surely engaged with the narrowing ring. Still further, with the pop-up suppressing portion being formed, the narrowing ring shifted to the lowermost position can be prevented from popping up by the elasticity of the leg portions. Further, even when it pops up, by the pop-up suppressing portion, the pop-up amount of the narrowing ring can be suppressed, whereby popping up of the narrowing ring that would startle the user can be prevented. Still further, with the holding projecting portion being formed at the mouth portion, when the dispenser pump is removed from the container body, the narrowing ring is held in the mouth portion by the holding projecting portion. Therefore, dispenser pump shifts upwardly relative to the narrowing ring until the narrowing ring engages with the restricting projecting portion. Then, when the dispenser pump shifted further upwardly in the state where the narrowing ring engages with the restricting projecting portion, the narrowing ring rides over the holding projecting portion and the dispenser pump is removed from the container body in the state where the narrowing ring is held at the lowermost position by the restricting projecting portion. That is, when the dispenser pump is removed from the container body, the narrowing ring is automatically held at the lowermost position and the leg portions are maintained in the closed-leg attitude. Therefore, when the attaching work of the dispenser pump to a new container body is to be performed, the dispenser pump can be attached to the new container body without switching the leg portions to the closed-leg attitude.

Further, with the abutment portion capable of being brought into surface contact with the bottom portion of the container body, the abutment portion being formed at a bottom end portion of each of the leg portions, the contact pressure between the bottom end portion of each leg portion and the bottom portion can be reduced. Thus, the problem that a hole is made at the bottom portion because of the contact with any leg portion can be avoided. Further, with the bottom end portion of each of the leg portions being arranged at an outer circumferential portion of the bottom portion of the container body, when the operation portion is pushed down diagonally, the push-down operation force of the operation portion can further effectively be received by allowing the bottom end portion of each of the leg portions to abut on the barrel portion of the container body.

Still another preferable mode is the pump-equipped container, further including: a suction pipe provided at the dispenser pump so as to extend from the pump body toward the bottom portion of the container body, wherein the support member is structured to be tubular, so as to be externally fitted to the suction pipe. In this case, by assembling the support member, the leg member, and the narrowing ring to the existing dispenser pump, the dispenser pump of the present invention can be structured. In addition, by arranging the bottom end portion of the suction pipe at the bottom portion outer circumferential portion of the container body, even when the container body is a container body prepared by blow molding, the content can substantially completely be taken out.

A preferable mode is the pump-equipped container in which the container body is made of a soft material that can be self-standing and that can be crushed by hands to achieve a reduction in volume. With such a structure, the container body after use is crushed to be small, so as to achieve a reduction in waste volume.

Another preferable mode is the pump-equipped container in which a barrel portion of the container body is structured to be tubular whose cross section is polygonal, the barrel portion being foldable. In this case, the container body after use is folded to be flat, and a reduction in waste volume can be achieved.

In the case where the barrel portion of the container body is structured to be tubular whose cross section is polygonal, it is preferable that a gusset portion is formed at each of opposing side faces of the barrel portion. With such a structure, the container body can smoothly and neatly be folded.

A preferable mode is the pump-equipped container further comprising a bottom face of the container body being formed so as to project downwardly with increasing proximity to the center portion. With such a structure, even when the support member is used as a suction pipe, the content can substantially completely be taken out. Further, the bottom end portion of the support member is substantially directly abutted on the placement face of the container having the bottom face of the container body interposed. Therefore, since the operation force when the operation portion is pushed down is received by the placement face, deformation or the like of the container body can further effectively be prevented.

A dispenser pump of the present invention is a dispenser pump used for the pump-equipped container, including: a pump body that has an operation portion capable of reciprocating in a top-bottom direction and that is removably attached to the mouth portion of the container body; a support member that has its bottom end portion abutted on the bottom portion of the container body to thereby receive a downward load acting on the mouth portion of the container body; and a leg member that is provided at the support member and that is capable of switching between a closed-leg attitude in which the leg member can pass through the mouth portion and an open-leg attitude in which the leg member spreads outwardly in a radial direction of the support member, the leg member receiving a diagonally downward load acting on the mouth portion of the container body by abutting on the bottom portion of the container body in the open-leg attitude. With the dispenser pump, by attaching the dispenser pump to the container body, it can similarly be used as the pump-equipped container.

Advantageous Effects of Invention

With the pump-equipped container and the dispenser pump used therefor of the present invention, since the push-down operation force of the operation portion is received by the support member and the leg member, even in both the cases where the operation portion is pushed down in the vertical direction and where the operation portion is diagonally pushed down, the push-down operation force of the operation portion can effectively be received. Accordingly, as the container body, a container body that is thinner and softer than the existing container body can be employed, and the material of the container body can be reduced as much as possible. Further, even in the case where the refill content is replaced together with the container body in order to eliminate the content refill work through use of a pouch, the waste attributed to a disposable container body can be minimized. Still further, since the container body can be crushed, a reduction in waste can also be achieved.

DESCRIPTION OF EMBODIMENTS

In the following, with reference to the drawings, a description will be given of an embodiment of the present invention.

Figure 1:
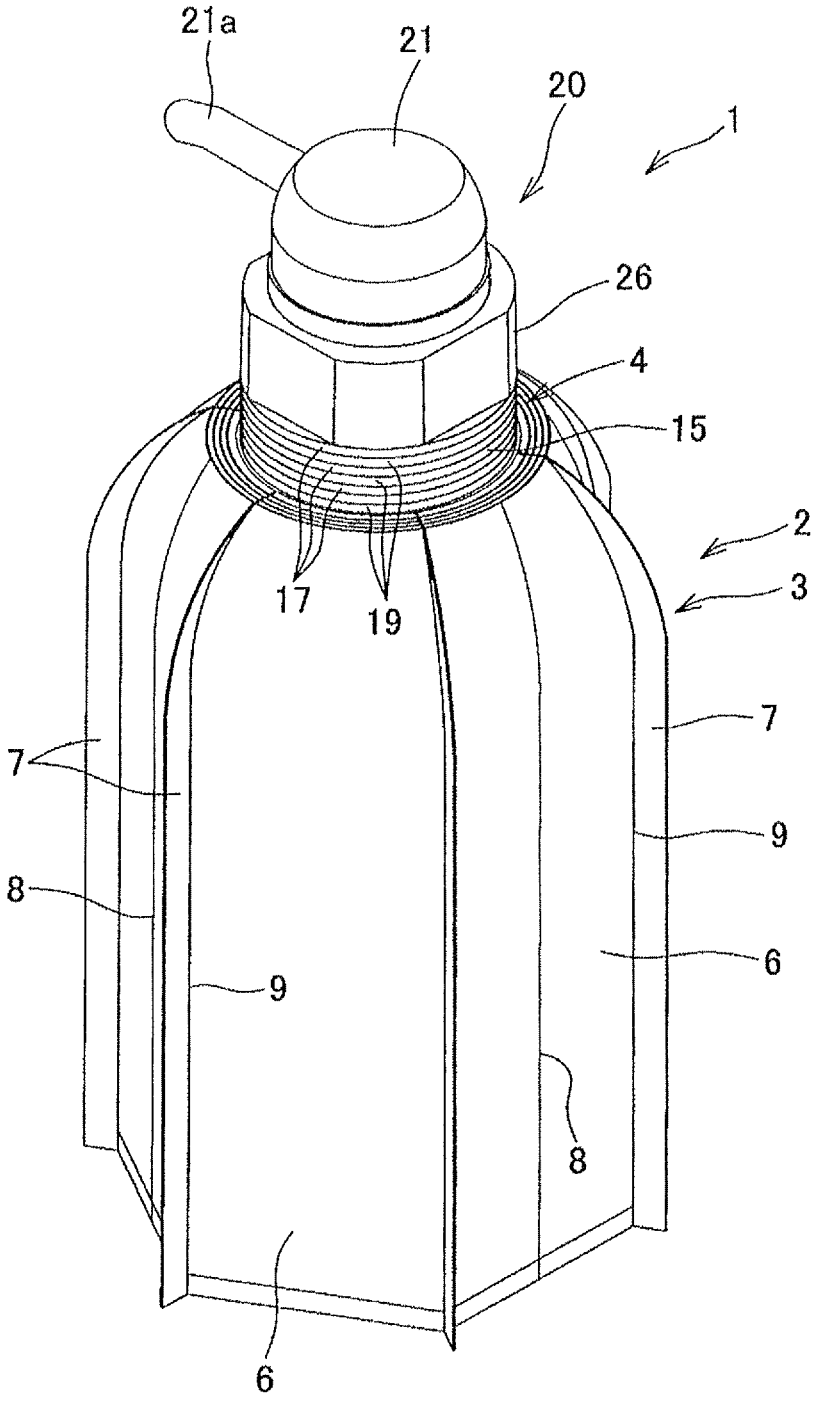
FIG. 1 is a perspective view of a pump-equipped container.
Figure 2:
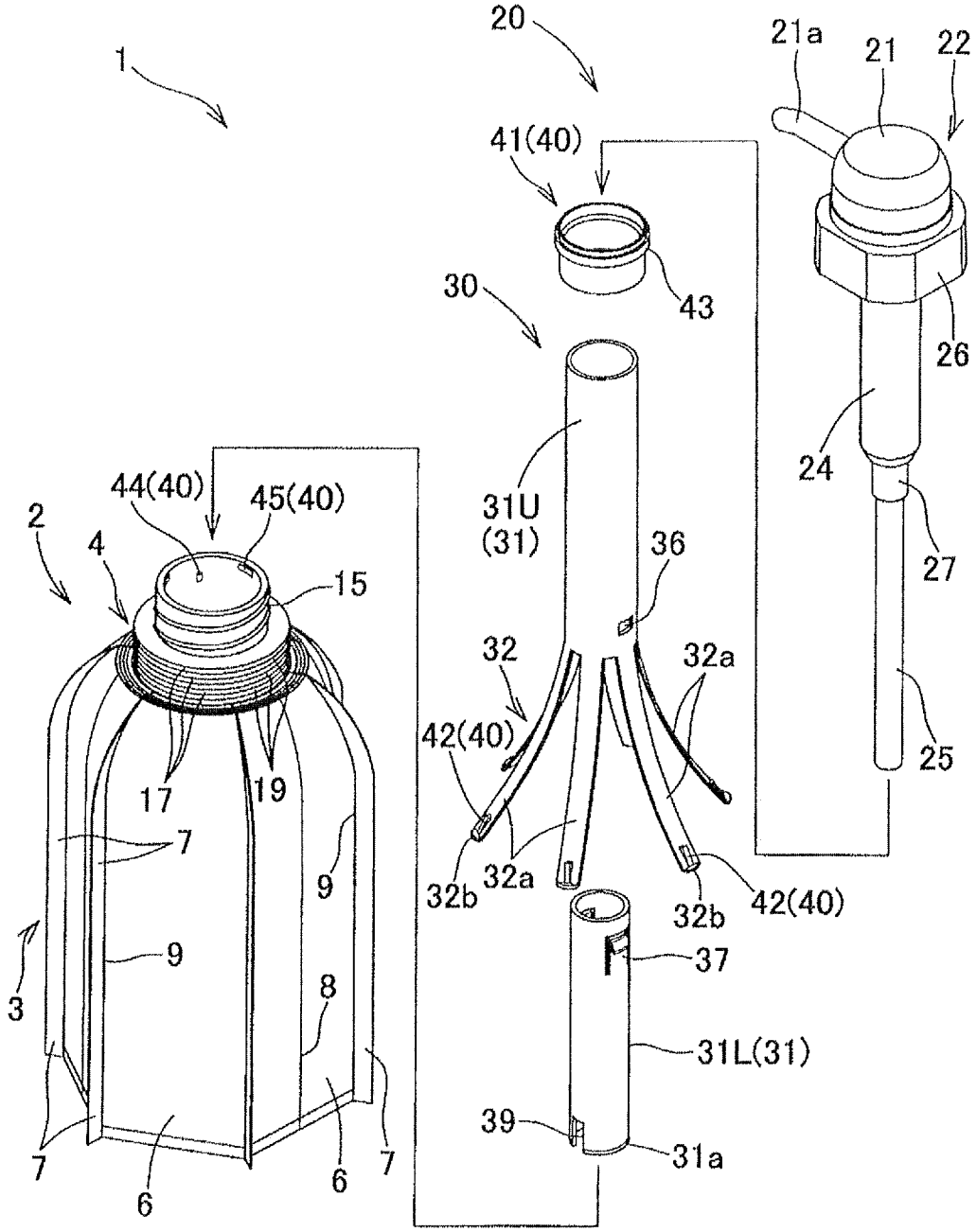
FIG. 2 is an exploded perspective view of the pump-equipped container.
Figure 3:
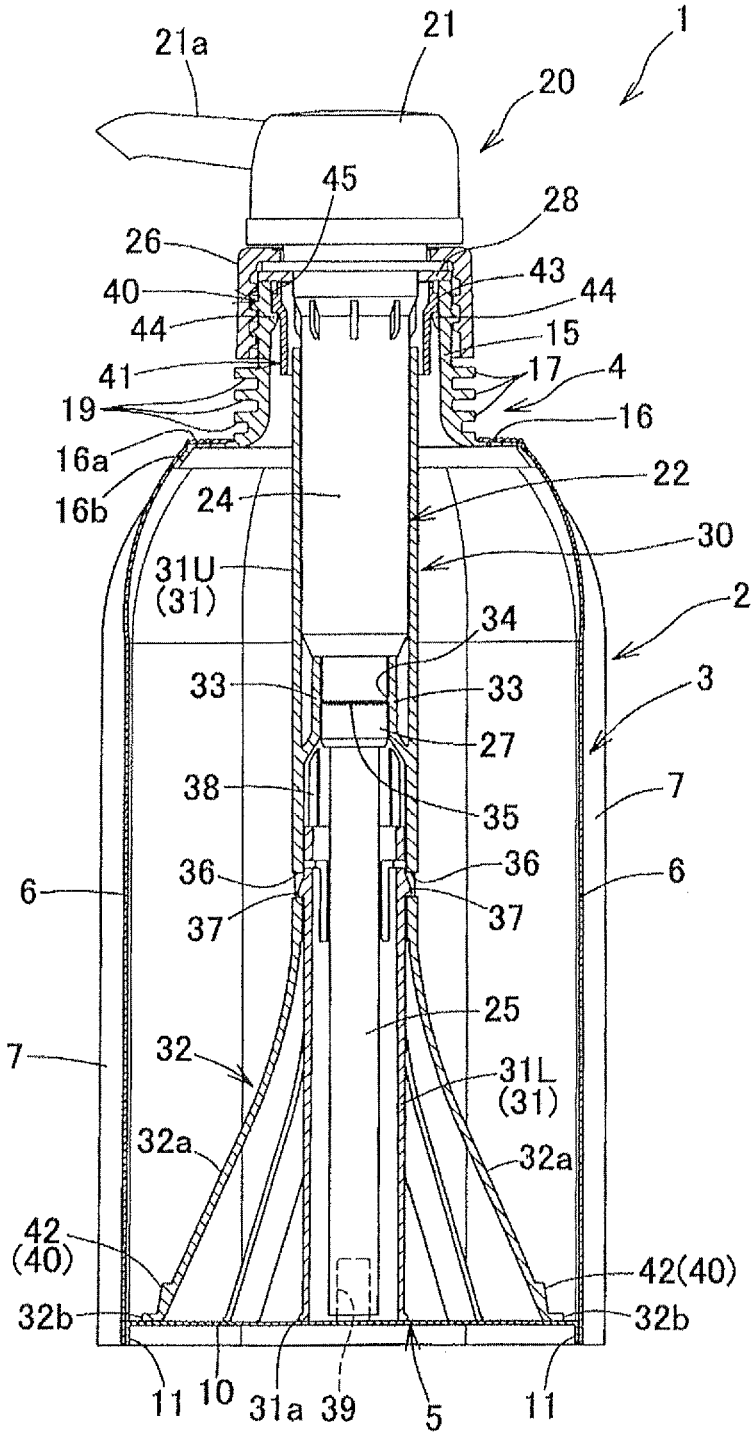
FIG. 3 is a vertical cross-sectional view of the pump-equipped container.

As shown in FIGS. 1 to 3, a pump-equipped container 1 includes a container body 2 that stores a liquid content such as shampoo or hair conditioner, and a dispenser pump 20 removably attached to a mouth portion 15 of the container body 2. It is to be noted that, FIG. 3 is a cross-sectional view of the pump-equipped container 1 in the unused state where an operation portion 21 is screwed to the top end portion of a cylinder 24.

(Container Body)

As shown in FIGS. 1 to 5, the container body 2 includes a hexagonal tubular barrel portion 3 whose diameter is gradually reduced at the upper portion, a mouth member 4 provided at the top end portion of the barrel portion 3, and a bottom portion 5 closing the bottom side opening of the barrel portion 3. The container body 2 is structured so as to be self-standing with the barrel portion 3 oriented in the vertical direction, and to be foldable by hands to achieve a reduction in volume.

Figure 4:
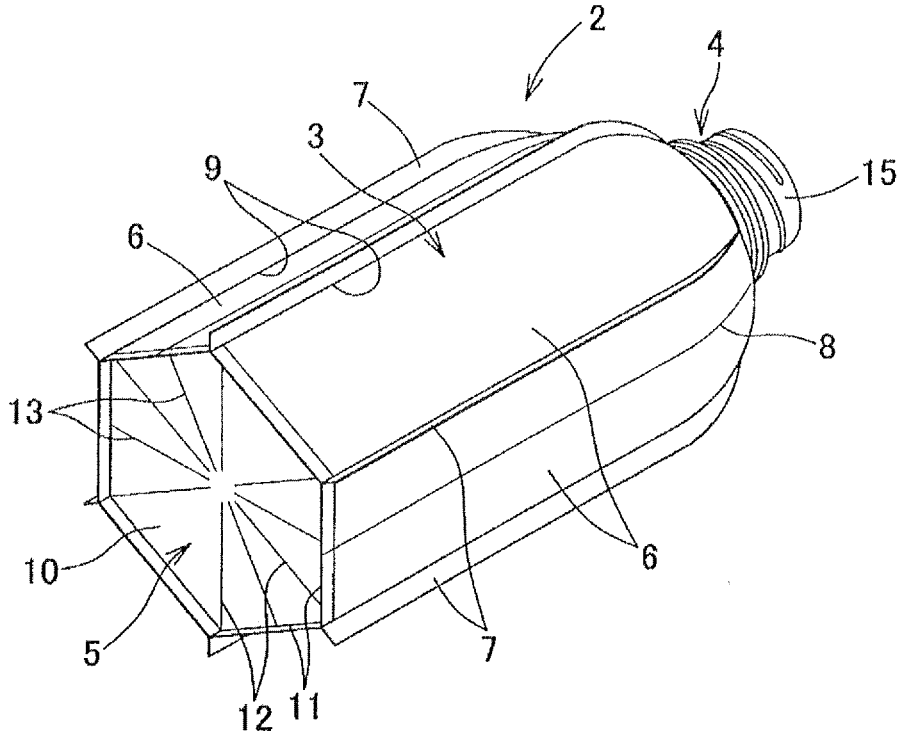
FIG. 4*a* is a perspective view of a container body.
FIG. 4*b* is a perspective view of the container body in the folded state.
Figure 4:
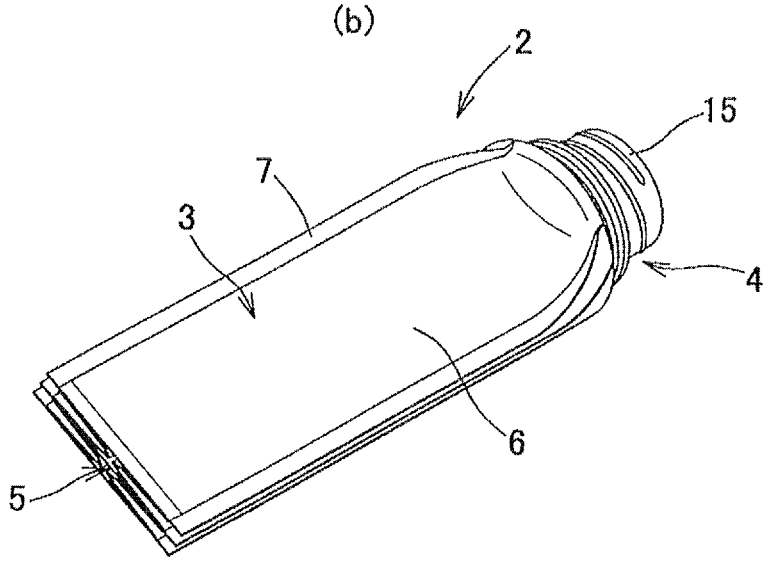

The barrel portion 3 is structured by joining six side-face sheets 6 each made of a synthetic resin-made sheet material of a substantially identical shape, to be a hexagonal tubular shape. On the opposing sides of each side-face sheet 6, joining portions 7 are formed over substantially the entire length in the top-bottom direction, and adjacent side-face sheets 6 have their respective joining portions 7 overlaid on each other, such that the joining portions 7 are joined by heat sealing, ultrasonic sealing or the like. The joining portions 7 are formed so as to project outwardly from the barrel portion 3. The container body 2 is structured so as to be self-standing stably in the vertical attitude thanks to the joining portions 7 functioning as the reinforce ribs of the barrel portion 3. As shown in FIG. 4, in connection with two pairs out of three pairs of side-face sheets 6 arranged in parallel to one another, i.e., four sheets in total, at the intermediate portion of the right-left direction (width direction) of each of the four side-face sheets 6, a barrel portion valley side folding line 8 that guides easier folding of the side-face sheet 6 inwardly of the barrel portion 3 is formed in the top-bottom direction (height direction) approximately over the entire length. At the base portion of each of the joining portions 7, a barrel portion mountain side folding line 9 is formed along the joining portion 7. By the four side-face sheets 6 being inwardly folded along their respective barrel portion valley side folding lines 8, and by the adjacent side-face sheet 6 being folded along their respective barrel portion mountain side folding lines 9, the barrel portion 3 is easily folded from the developed attitude shown in FIG. 4*a* to the flat plate-like folded attitude shown in FIG. 4*b* by hands. It is to be noted that the four side-face sheets 6 where the barrel portion valley side folding lines 8 are formed correspond to the gusset portions.

The bottom portion 5 is made of a synthetic resin-made hexagonal sheet material, and includes a hexagonal bottom face portion 10 that closes the bottom end opening of the barrel portion 3, and a joining portion 11 formed by the outer circumference of the bottom face portion 10 being folded downwardly. The bottom portion 5 is integrally attached to the barrel portion 3 by the bottom portion 5 being attached to the bottom end opening of the barrel portion 3, such that the joining portions 11 are overlaid on the bottom end inner face of the barrel portion 3, and that the joining portions are joined to the bottom end portion of the barrel portion 3 in a liquid-tight manner through heat sealing or ultrasonic sealing. At the bottom face portion 10, bottom portion mountain side folding lines 12 that radially extend from the center portion so as to be continuous to the barrel portion mountain side folding lines 9 are formed. Also, bottom portion valley side folding lines 13 that radially extend from the center portion so as to be continuous to the barrel portion valley side folding lines 8 are formed. By the bottom portion valley side folding lines 13 being folded inwardly relative to the container body 2 and the bottom face portion 10 being mountain-folded along the bottom portion mountain side folding lines 12, it can easily be folded from the developed attitude shown in FIG. 4*a* to the flat plate-like folded attitude shown in FIG. 4*b* by hands. It is to be noted that, though the bottom face portion 10 may be flat, it is also preferable that the bottom face portion 10 is in a mortar-like shape which projects downwardly with increasing proximity to the center portion, so that the content can substantially completely be taken out by the dispenser pump 20.

It is to be noted that, though it is preferable that the barrel portion 3 and the bottom portion 5 are structured by an identical synthetic resin material, it is also possible to structure them by synthetic resin materials of different types. As the sheet material structuring the barrel portion 3 and the bottom portion 5, it is possible to use a sheet material of a single layer structure or a multilayer structure made of one or more synthetic resin material. Alternatively, a multilayer structure sheet material in which a metal foil such as an aluminum foil is laminated may be used. Further, it is also possible to use a film material in place of the sheet material. Still further, while the barrel portion 3 is structured by the six side-face sheets 6 being joined, it can be replaced by the structure in which one sheet material is folded in a hexagonal tubular shape with the opposite end portions being joined. Still further, it can be replaced by the structure in which two or three sheet materials are joined into a hexagonal tubular shape. Still further, so long as the barrel portion 3 is tubular whose cross section is polygonal, it can be any polygonal tubular shape in place of a hexagonal tubular shape, e.g., a quadrangular tubular shape, a pentagonal tubular shape or the like. The bottom portion 5 may be formed into any polygonal shape in accordance thereto. Further, it is also possible to form the barrel portion 3 to have a substantially cylindrical or a substantially elliptic cylindrical shape, and to form the bottom portion 5 to have a circular-plate like or elliptic-plate like shape. Still further, the folding method of the container body 2 may include, in addition to the folding method performed along the folding lines as described above, structuring the barrel portion 3 by a soft material such that it can be crushed by hands to achieve a reduction in volume. Thus, as the container body 2, so long as the barrel portion 3 can be vertically self-standing and can be folded or crushed by hands to easily achieve a reduction in volume, any structure can be employed. For example, the structure prepared by blow molding can be employed.

Figure 5:
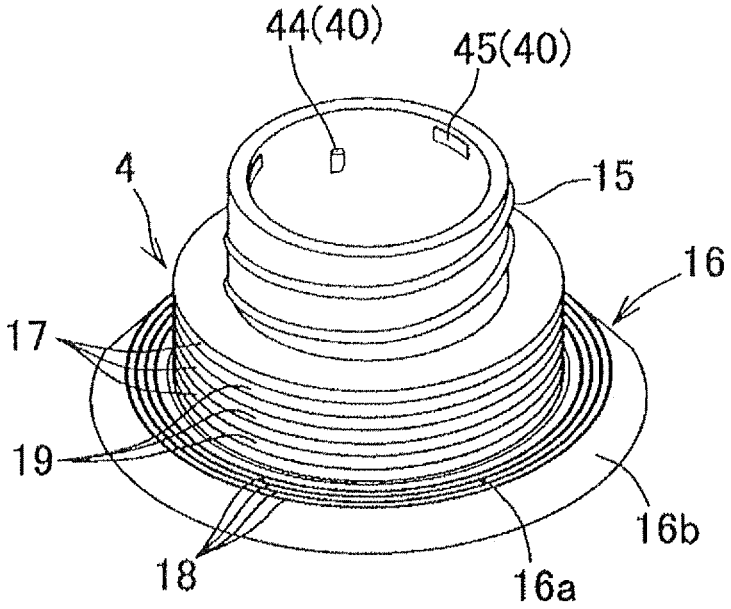
FIG. 5 is a perspective view of a mouth member.

As shown in FIGS. 3 and 5, the mouth member 4 is structured as a synthetic resin-made integral molding product, and includes a substantially cylindrical mouth portion 15 provided with a male screw at its outer circumference, a shoulder portion 16 that is circular as seen in a plan view and that extends outwardly from the bottom end portion of the mouth portion 15, and a plurality of support flanges 17 provided at the bottom portion of the mouth portion 15 so as to project outwardly. The shoulder portion 16 includes an annular flange portion 16*a* that extends from the bottom end portion of the mouth portion 15 outwardly and substantially perpendicularly, and a cone-frustum-like skirt portion 16*b* that extend diagonally downward from the outer circumferential portion of the flange portion 16*a*. At the top face of the flange portion 16*a*, four seal portions 18 each being an annular projection portion are coaxially formed along the outer circumferential portion of the flange portion 16*a*. The barrel portion 3 is joined to the shoulder portion 16 in a liquid-tight manner, by having the inner face side of the top end portion overlaid on the top face of the flange portion 16*a*, and fusing the top end portion to the seal portions 18 through heat sealing, ultrasonic sealing or the like. Between the adjacent support flanges 17 and between the shoulder portion 16 and the support flange 17, annular gaps 19 are formed. The container body 2 can be handled by inserting a fork sideways into the annular gaps 19. It is to be noted that, though the skirt portion 16*b* is formed so as to diagonally extend downwardly, the present invention is not limited thereto. It is also possible to form the skirt portion 16*b* so as to vertically extend downwardly from the outer circumferential portion of the flange portion 16*a*. Further, though the seal portions 18 are formed four in number, it can be formed in an arbitrary number according to the material of the sheet material structuring the barrel portion 3.

Figure 6:
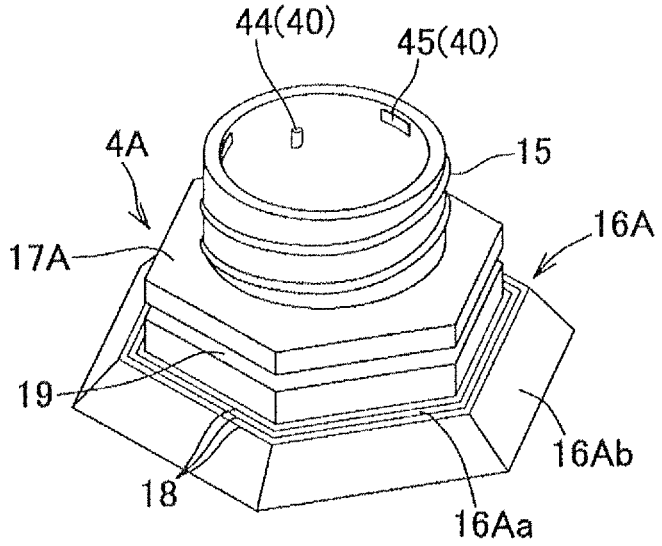
FIGS. 6*a* and 6*b* are each a perspective view of the mouth member in other structure.
Figure 6:
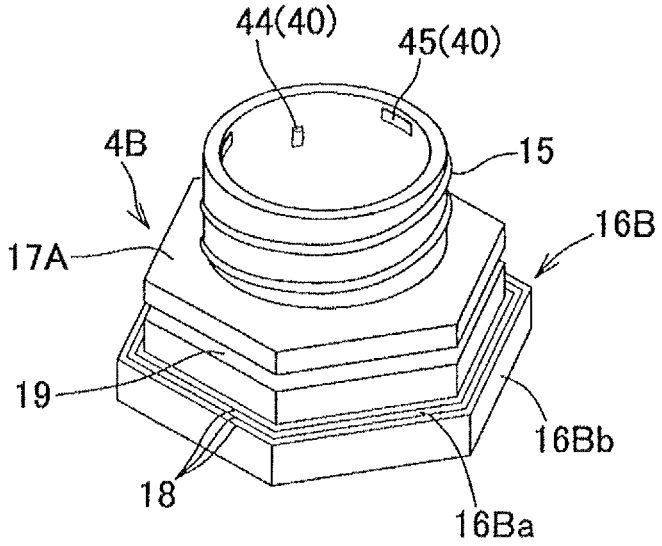

It is to be noted that, though the shoulder portion 16 is preferably formed to be circular in consideration of positioning of the container body 2, it is also possible to form the shoulder portion 16 to be an arbitrary shape according to the shape or the like of the container body 2. For example, in place of the flange portion 16*a* and the skirt portion 16*b*, similarly to a shoulder portion 16A of a mouth member 4A shown in FIG. 6*a*, a flange portion 16Aa having a hexagonal shape as seen in a plan view and a hexagonal pyramid frustum-like skirt portion 16Ab can be provided. Further, in order to improve the attaching performance of the mouth member 4 to the top end portion of the barrel portion 3, the following is possible, for example: forming the barrel portion 3 to be a hexagonal tubular shape; and providing a flange portion 16Ba having a hexagonal shape as seen in a plan view and a skirt portion 16Bb having a hexagonal tubular shape similarly to the shoulder portion 16B of the mouth member 4B as shown in FIG. 6*b* in place of the flange portion 16*a* and the skirt portion 16*b*; externally fitting the top end portion of the barrel portion 3 to the skirt portion 16B; and fusing the top end portion of the barrel portion 3 to the side face of the skirt portion 16Bb. In this case, the seal portions 18 each being an annular projection portion may be formed at the flange portion 16Aa and the skirt portion 16Bb, so that the top end portion of the barrel portion 3 is surely fused to the mouth member 4. Further, the shape of the support flange 17 may be formed in any shape in consideration of design. For example, similarly to a support flange 17A of the mouth member 4A shown in FIG. 6*a*, it may be formed to have a hexagonal shape as seen in a plan view so as to conform to the shape of the shoulder portion 16. Further, the number of pieces of the support flanges 17 may also arbitrarily be set. For example, it may be provided just one in number similarly to the mouth member 4A shown in FIG. 6*a*. Further, the number of pieces of the seal portion 18 can be set to the number other than four. Still further, the skirt portion 16*b* can be eliminated.

(Dispenser Pump)

As shown in FIGS. 1 to 3, the dispenser pump 20 includes a pump body 22 that has the operation portion 21 that can reciprocate in the top-bottom direction and that is removably attached to the mouth portion 15 of the container body 2, and support means 30 for receiving the operation force when the operation portion 21 is pushed down.

Figure 9:
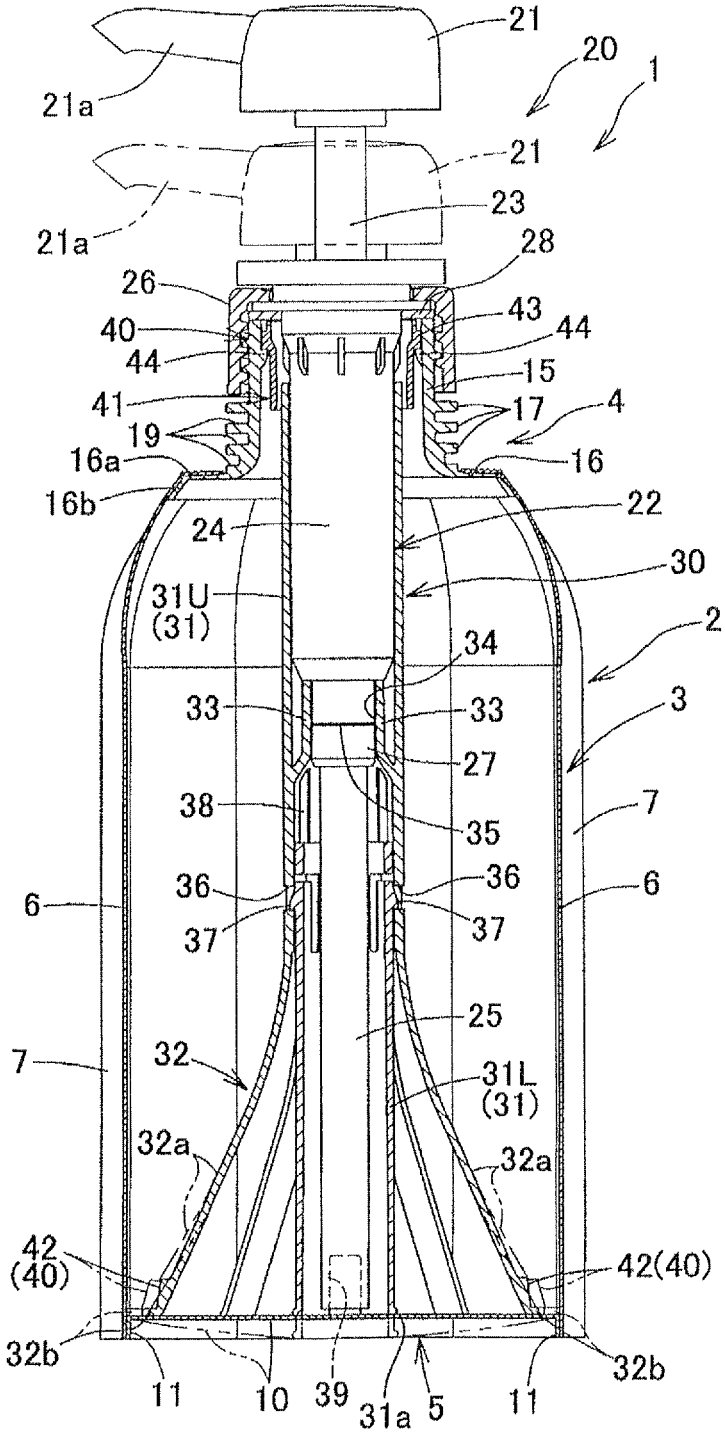
FIG. 9 is an explanatory view of a method of dispensing the content from the pump-equipped container.

As indicated by phantom lines in FIG. 9, the pump body 22 has the following known structure. By the operation portion 21 being pushed down, a not-shown piston moves downwardly in the cylinder 24 via a stem 23, and the content in the cylinder 24 passes through the passage in the stem 23, to be discharged from a nozzle 21*a* provided at the operation portion 21. When the hand leaves the operation portion 21, the operation portion 21 upwardly shifts together with the piston by a not-shown spring member installed in the cylinder 24, as indicated by solid lines in FIG. 9. Then, the content in the container body 2 is suctioned into the cylinder 24 through a suction pipe 25. As the pump body 22, any structure in addition to that described above can be employed.

Around the top end of the cylinder 24, a lid 26 is externally fitted so as to be rotatable and to be incapable of shifting vertically. The pump body 22 is attached to the container body 2 so as to close the mouth portion 15, by the lid 26 being screwed with the mouth portion 15 of the container body 2. Further, at the bottom end portion of the cylinder 24, a small-diameter cylindrical attachment portion 27 is integrally formed so as to project downwardly. Into the attachment portion 27, the top end portion of the suction pipe 25 is internally fitted, so that the suction pipe 25 can be connected to the cylinder 24. It is to be noted that, a seal ring for sealing the mouth portion 15 is denoted by the reference symbol 28.

(Support Means)

The support means 30 includes: a support member 31 that receives the downward load acting on the mouth portion 15 of the container body 2 by its bottom end portion abutting on the center portion of the bottom face portion 10 of the container body 2; and a leg member 32 that is provided at the support member 31, and that is capable of switching between a closed-leg attitude in which the leg member 32 can pass through the mouth portion 15 and an open-leg attitude in which the leg member 32 spreads outwardly in the radial direction of the support member 31. In the open-leg attitude, the leg member 32 receives the diagonally downward load acting on the mouth portion 15 of the container body 2 by abutting on the bottom face portion 10 of the container body 2.

The support member 31 is structured as being divided into a top support member 31U and a bottom support member 31L. The support members 31U and 31L are cylindrically structured, and the top end portion of the bottom support member 31L is inwardly fitted into the bottom end portion of the top support member 31U in the top-bottom direction, so as to be incapable of relatively shifting. It is to be noted that, the top support member 31U and the bottom support member 31L can be formed in a shape other than a cylindrical shape, e.g., a quadrangular tubular shape.

In the state where the dispenser pump 20 is assembled to the container body 2, as shown in FIGS. 3 and 9, the bottom end portion of the support member 31 abuts on the bottom face portion 10 of the container body 2, or the bottom end portion of the support member 31 abuts on the bottom face portion 10, whereby the center portion of the bottom portion 5 is slightly pushed down. By the operation portion 21 being pushed down, as indicated by phantom lines in FIG. 9, the bottom end portion of the bottom support member 31L pushes down the bottom face portion 10, whereby the bottom end portion of the bottom support member 31L abuts on the placement face of the container body 2 via the bottom face portion 10. Thus, the push-down operation force of the operation portion 21 is received. However, it is also possible to structure in the following manner: in the state where the dispenser pump 20 is assembled to the container body 2, the bottom end portion of the bottom support member 31L is arranged with a slight gap relative to the bottom face portion 10; by the operation portion 21 being pushed down, the bottom end portion of the bottom support member 31L abuts on the bottom face portion 10, whereby the bottom support member 31L pushes down the bottom face portion 10.

Figure 8:
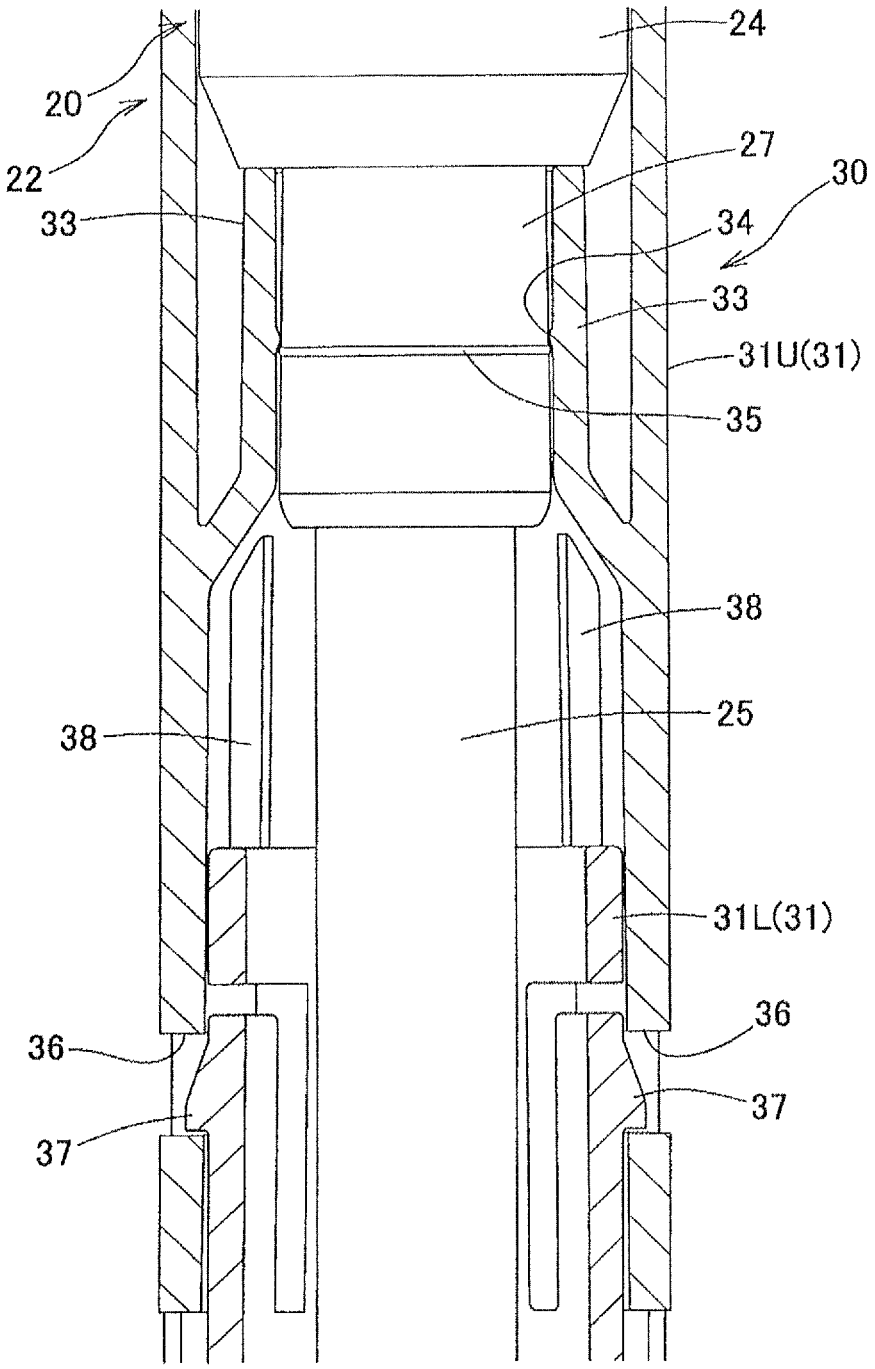
FIG. 8 is a substantial part enlarged vertical cross-sectional view around the connecting portion of top and bottom support members of a dispenser pump.

The top portion of the top support member 31U is externally fitted to the cylinder 24 substantially with no gap. Inside the intermediate portion in the height direction of the top support member 31U, top engaging stopper nails 33 extending upwardly are integrally formed at intervals in the circumferential direction. Such a plurality of top engaging stopper nails 33 are arranged such that the inner circumferential face thereof is pressed against the attachment portion 27. Abutment of the top end portions of the top engaging stopper nails 33 on the bottom face of the cylinder 24 restricts upward shifting of the top support member 31U. As shown in FIG. 8, at the intermediate portion in the height direction of the inner circumferential face of each of the top engaging stopper nails 33, an engaging projection 34 extending in the circumferential direction is formed. At the intermediate portion in the height direction of the outer circumferential face of the attachment portion 27, an engaging stopper projection 35 extending in the circumferential direction is formed. The top support member 31U is held so as not to downwardly shift relative to the cylinder 24, by the engaging projection 34 riding over and engaging with the engaging stopper projection 35, in the state where the top support member 31U is externally fitted to the cylinder 24 and the top end portions of the top engaging stopper nails 33 abut on the bottom face of the cylinder 24.

Near the bottom end of the top support member 31U, a plurality of rectangular hole-like engaging holes 36 are formed at certain intervals in the circumferential direction. Near the top end of the bottom support member 31L, bottom engaging stopper nails 37 capable of engaging with the engaging holes 36 are integrally formed at certain intervals in the circumferential direction. Below the top engaging stopper nails 33 and on the inner circumferential face of the top support member 31U, four engaging stopper ribs 38 are formed in the top-bottom direction at certain intervals in the circumferential direction. The bottom support member 31L is coupled to the top support member 31U so as not to be capable of shifting in the top-bottom direction, by the top end portion of the bottom support member 31L being internally fitted into the bottom end portion of the top support member 31U and the top end portion abutting on the bottom end portion of the engaging stopper rib 38, whereby the bottom engaging stopper nails 37 engage with the engaging holes 36.

At the bottom end portion of the bottom support member 31L, a cut out portion 39 is formed. In the state where the bottom end portion of the bottom support member 31L abuts on the bottom portion 5 of the container body 2, the content in the container body 2 is guided into the bottom support member 31L through the cut out portion 39.

Figure 10:
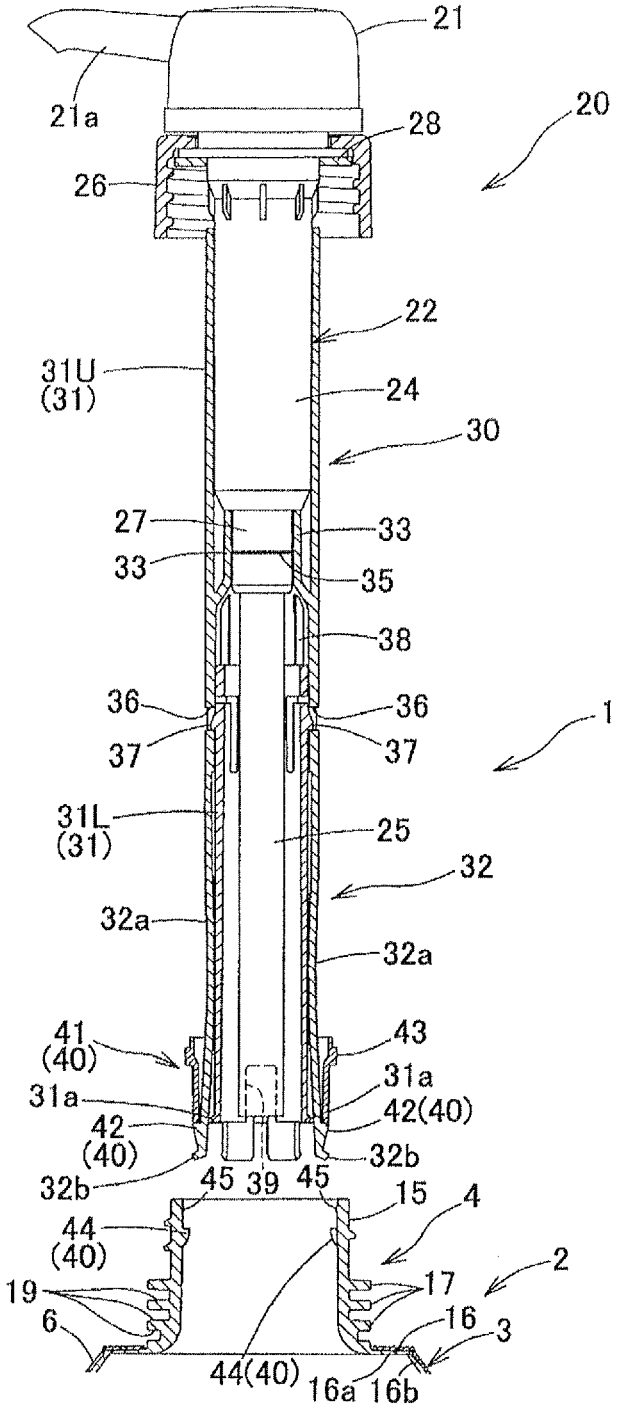
FIG. 10 is an explanatory view showing the state immediately before the dispenser pump is attached to the container body and immediately after the dispenser pump is removed from the container body.

The leg member 32 is made up of a plurality of leg portions 32*a* that spread radially and diagonally downwardly from the bottom end portion of the top support member 31U. The plurality of leg portions 32*a* are structured to be capable of switching between the open-leg attitude in which the leg portions 32*a* spread radially and diagonally downwardly, i.e., the natural state shown in FIG. 3, and the closed-leg attitude in which the leg portions 32*a* elastically deform so as to conform to the bottom support member 31L as shown in FIG. 10. Then, when the dispenser pump 20 is attached to the container body 2, as shown in FIG. 10, the plurality of leg portions 32*a* being elastically deformed in the closed-leg attitude are inserted into the mouth portion 15 of the container body 2 from the bottom end thereof. After the dispenser pump 20 is attached to the container body 2, as shown in FIG. 3, the plurality of leg portions 32*a* elastically return to the open-leg attitude.

Though the number of pieces of the leg portions 32*a* can arbitrarily be set, it is preferable that they are provided at least three in number, such that the diagonal downward pushing operation force of the operation portion 21 can effectively be received over the entire circumference. When the number of pieces is excessively great, the manufacturing cost is increased. Therefore, preferably, the leg portions 32*a* are provided about six to eight in number. Further, when the barrel portion is formed in a polygonal tubular shape, it is preferable to arrange the leg portions 32*a* so as to correspond to respective corners of the barrel portion, or to arrange each leg portion 32*a* so as to correspond to every second corner. When the length of the leg portions 32*a* is excessively short, the diameter of the bottom end in the open-leg attitude becomes small, and the diagonally downward load cannot effectively be received. When the length of the leg portions 32*a* is excessively long, the leg portions 32*a* elastically deform too easily, and the diagonally downward load cannot effectively be received. Therefore, the length is preferably set to be ⅓ to ⅔ as long as the support member 31.

At the bottom end portion of each leg portion 32*a*, an abutment portion 32*b* is formed. The abutment portion 32*b* extends sideways substantially horizontally in the open-leg attitude, and is capable of being brought into surface contact with the bottom face portion 10. Thus, the contact pressure between the bottom end portion of each leg portion 32*a* and the bottom face portion 10 is reduced, whereby the bottom face portion 10 is not easily damaged by the contact with each leg portion 32*a*. Further, the tip portion of each abutment portion 32*b* is formed to be arc-shaped, whereby the barrel portion 3 or the bottom portion 5 is not easily damaged by the contact with the tip portion of each abutment portion 32*b*.

In the open-leg attitude being the natural state, the abutment portion 32*b* of the bottom end portion of each leg portion 32*a* is arranged at substantially the same height position as the bottom end portion of the bottom support member 31L. As shown in FIGS. 3 and 9, in the state where the dispenser pump 20 is attached to the container body 2, the bottom face of the abutment portion 32*b* abuts on the bottom face portion 10 of the container body 2, or the bottom face of the abutment portion 32*b* abuts on the bottom face portion 10 of the container body 2 whereby the abutment portion 32*b* spreads outwardly. As shown in FIG. 9, by the operation portion 21 being pushed down, the bottom end portions of the abutment portions 32*b* spread outwardly while abutting on the bottom face portion 10, and the tip portions of the abutment portions 32*b* abut on the bottom end portion of the barrel portion 3. Thus, the operation portion 21 can stably be pushed downwardly in the vertical direction. Further, the push-down operation force occurring when the operation portion 21 is diagonally pushed down is received by the leg portions 32*a*. Thus, any deformation of the container body 2 due to the push-down operation force can be prevented. However, it is also possible to structure such that, in the state where the dispenser pump 20 is assembled to the container body 2, the bottom end portions of the leg portions 32*a* are arranged with a slight gap relative to the bottom face portion 10, and by the operation portion 21 being pushed down, the bottom end portions of the leg portions 32*a* abut on the bottom face portion 10 of the container body 2 and spread outwardly.

It is to be noted that, in the present embodiment, a plurality of leg portions 32*a* that can elastically deform are provided as the leg member 32. However, it is also possible to provide leg portions that can switch the attitude by a hinge or the like, between the closed-leg attitude in which the leg portions can pass through the mouth portion 15, and the open-leg attitude in which the leg portions spread outwardly in the radial direction of the support member 31. Thus, in the open-leg attitude, the leg portions abutting on the bottom portion 5 of the container body 2 can receive the diagonally downward load acting on the mouth portion 15 of the container body 2. Further, it is also possible to structure the leg member 32 and the top support member 31U as separate members. Still further, it is also possible to structure the top support member 31U and the bottom support member 31L as a support member being an integrally molded product, and to fix the leg member 32 being a separate member than the support member to the intermediate portion in the height direction of the support member.

Further, in the present embodiment, the bottom end portion of the support member 31 and the abutment portions 32*b* of the bottom end portions of the leg portions 32*a* in the open-leg attitude are arranged substantially at the same height. However, so long as the bottom end portion of the support member 31 and the abutment portions 32*b* of the bottom end portions of the leg portions 32*a* abut on the bottom portion 5 in the state where the operation portion 21 is pushed down, and the push-down operation force of the operation portion 21 can be received by the support means 30, it is also possible to arrange them at different heights in accordance with the shape of the bottom portion 5 and the like. Further, though the distance between the bottom end portion of the leg portions 32*a* and the support member 31 in the open-leg attitude can arbitrarily be set, it is preferable to set the bottom end portions of the leg portions 32*a* at the farthest positions from the support member 31, that is, to arrange the bottom end portions of the leg portions 32*a* at the outer edge portion of the bottom portion 5, because the stability of operation when the operation portion 21 is pushed diagonally downwardly improves.

Next, a description will be given of switching means 40 for switching the leg member 32 between the open-leg attitude and the closed-leg attitude. It is to be noted that, it is also possible to dispense with the switching means 40. In this case, the leg portions 32*a* are converged in the closed-leg attitude directly by hands, and the leg portions 32*a* are inserted into the mouth portion 15 of the container body 2. Then, the dispenser pump 20 is attached to the container body 2.

Figure 7:
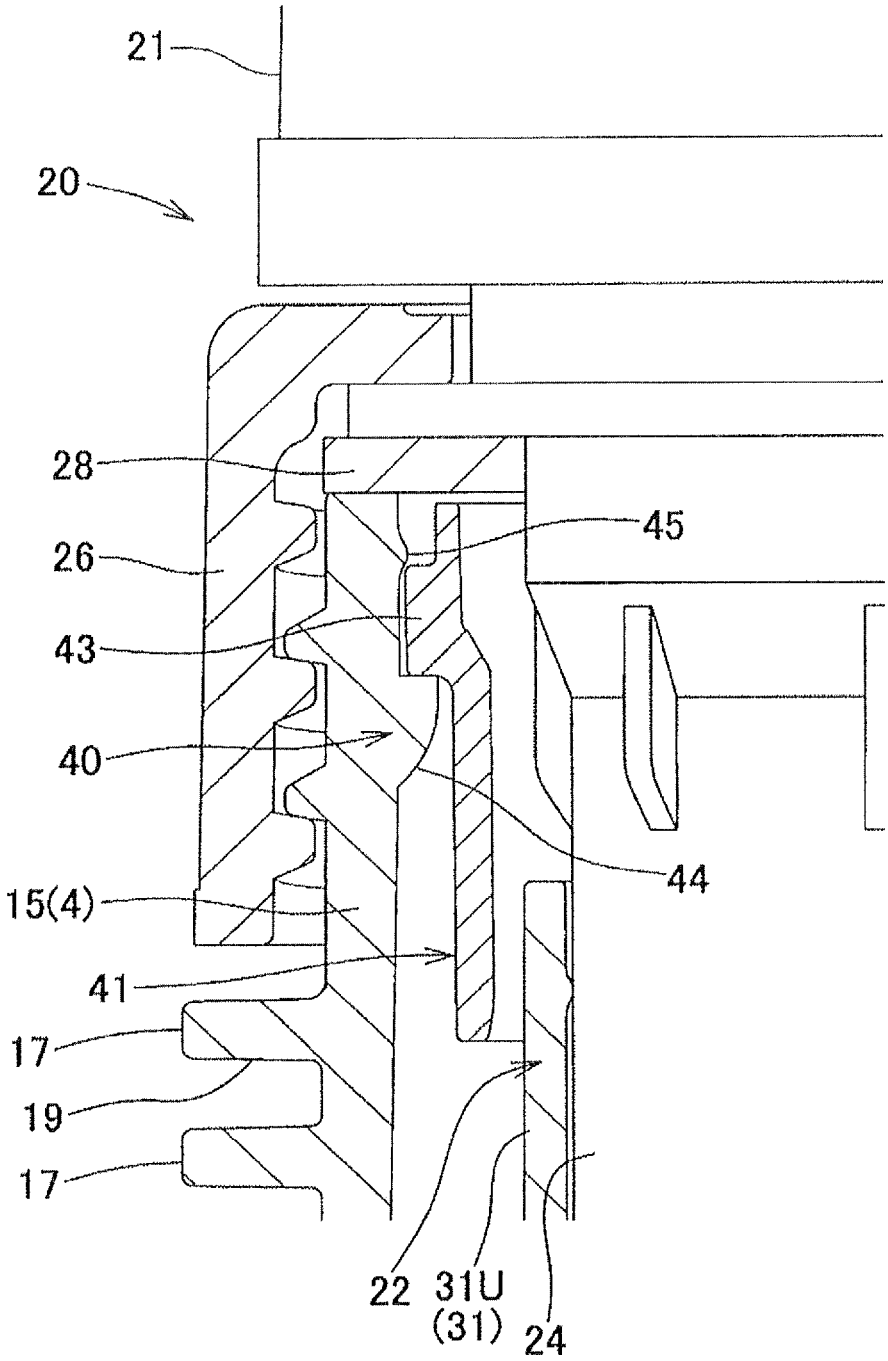
FIG. 7 is a substantial part enlarged vertical cross-sectional view around the mouth portion of the pump-equipped container.

Now, a description will be given of the switching means 40. As shown in FIGS. 2, 3, and 7, a cylindrical narrowing ring 41 is externally fitted over the top end of the top support member 31U to the bottom end portion of the leg member 32 so as to be shiftable upwardly and downwardly. At the center portion in the width direction of the bottom end portion of each leg portion 32*a*, a restricting projecting portion 42 that is triangular as seen in a side view and that restricts the lowermost position of the narrowing ring 41 is formed so as to outwardly project. Further, at the bottom end portion of the support member 31, a receiving projecting portion 31*a* projecting outwardly is formed. The receiving projecting portion 31*a* is arranged so as to correspond to the top end portion of the restricting projecting portion 42 in the state where the leg portions 32*a* are in the closed-leg attitude. As shown in FIG. 10, in the state where the narrowing ring 41 is shifted toward the lowermost position, inward shifting of the restricting projecting portion 42 is restricted by the receiving projecting portions 31*a*, and the bottom end portion of the narrowing ring 41 surely engages with the restricting projecting portion 42. However, it is also possible to provide the restricting projecting portion 42 at the intermediate portion in the height direction of each of the leg portions 32*a*, such that the restricting projecting portion engagingly stops the narrowing ring 41, whereby the narrowing ring 41 is held at the lowermost position. Further, an element of any shape can be employed as the restricting projecting portion 42 so long as it can engage with the narrowing ring 41 to restrict the lowermost position of the narrowing ring 41. However, it is preferable to employ the shape that is triangular as seen in a side view, because the elastic deformation of the bottom end portions of the leg portions 32*a* is facilitated. Further, the restricting projecting portion 42 can be provided to every leg portion 32*a*. Alternatively, the restricting projecting portion 42 can be provided to a particular leg portion 32*a*, e.g., every second leg portion 32*a* in the circumferential direction. Further, in place of the receiving projecting portion 31*a*, a receiving projecting portion can be formed on the inner face side of each leg portion 32*a* so as to correspond to the top end portion of the restricting projecting portion 42, such that the receiving projecting portion in the closed-leg attitude abuts on the bottom end portion of the support member 31, to restrict the inward shifting of the restricting projecting portion 42.

The outer diameter of the narrowing ring 41 is set to have a dimension capable of being internally fitted into the mouth portion 15 of the container body 2. At the top portion of the narrowing ring 41, a collar portion 43 is formed so as to project outwardly. At the top portion of the inner circumferential face of the mouth portion 15 of the container body 2, three engaging stopper projecting portions 44 projecting inwardly are provided at certain intervals in the circumferential direction. The narrowing ring 41 is held inside the top portion of the mouth portion 15 by the collar portion 43 engaging from above with the engaging stopper projecting portions 44. The number of pieces, the cross-sectional shape, the position in the circumferential direction, the length and the like of the projecting portions can arbitrarily be changed, so long as the engaging stopper projecting portions 44 allow the support member 31 to enter or leave the container body 2, while receiving the narrowing ring 41 from below to thereby engagingly stop the narrowing ring 41 inside the mouth portion 15.

On the side higher than the engaging stopper projecting portions 44, holding projecting portions 45 projecting inwardly are formed in the mouth portion 15. The holding projecting portions 45 are arranged above the narrowing ring 41 held by the engaging stopper projecting portions 44, such that the narrowing ring 41 rides over the holding projecting portions 45 when a relatively great force in the top-bottom direction is acted on the narrowing ring 41. The holding force of the narrowing ring 41 by the holding projecting portions 45 is set to be greater than the sliding resistance of the narrowing ring 41 when it upwardly and downwardly shifts relative to the leg portions 32*a*. When the dispenser pump 20 is to be removed from the container body 2, in the state where the narrowing ring 41 is held inside the mouth portion 15 by the holding projecting portions 45, the dispenser pump 20 can upwardly shift until the narrowing ring 41 engages with the restricting projecting portions 42. Then, in the state where the narrowing ring 41 is engaged with the restricting projecting portion 42, that is, in the state where the narrowing ring 41 is held at the lowermost position of the leg portions 32*a*, when the dispenser pump 20 is shifted upwardly, the narrowing ring 41 rides over the holding projecting portions 45 such that the dispenser pump 20 can be removed from the container body 2. The number of pieces of the holding projecting portions 45 can arbitrarily be set. For example, three holding projecting portions 45 may be formed on the inner circumferential face of the mouth portion 15 at certain intervals in the circumferential direction. The engaging stopper projecting portions 44 and the holding projecting portion 45 can be formed at the same position in the circumferential direction one above the other, or they can be formed at different positions in the circumferential direction.

Figure 14:
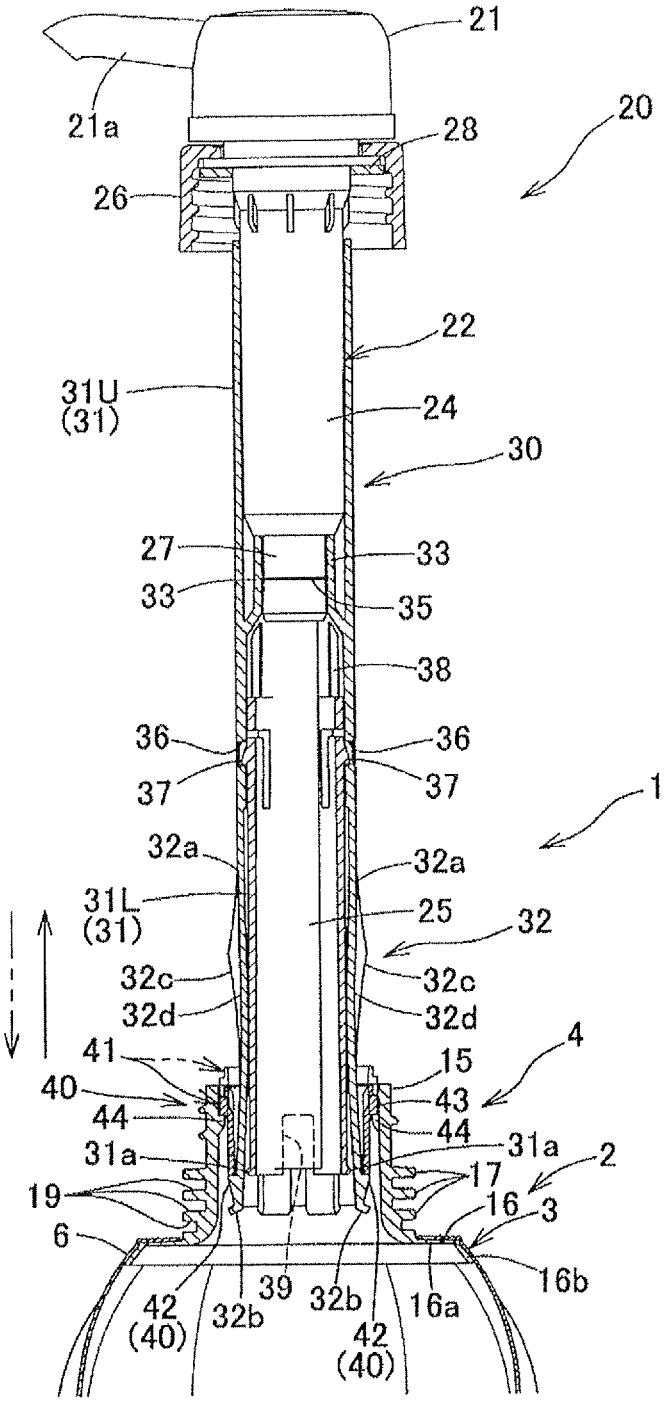
FIG. 14 is a diagram corresponding to FIG. 11 in the case where the structure of the leg portions is partially changed.

It is to be noted that, as shown in FIG. 14, on the outer side face of each leg portion 32*a* in the closed-leg attitude, a pop-up suppressing portion 32*c* that projects sideways toward the intermediate portion in the height direction may be formed. The pop-up suppressing portion 32*c* may be formed by a rib portion 32*d* that is formed to project at the center portion in the width direction on the outer side face of each leg portion 32*a*, or it may be formed by bending the intermediate portion in the height direction of each leg portion 32*a*. In this manner, as shown in FIG. 14, formation of the pop-up suppressing portion 32*c* can prevent the narrowing ring 41 from popping up from the lowermost position by the elasticity of the leg portions 32*a* midway through insertion of the dispenser pump 20 into the container body 2. Further, even when the narrowing ring 41 pops up, the pop-up amount of the narrowing ring 41 can be suppressed by the pop-up suppressing portion 32*c*. Thus, popping-up of the narrowing ring that would startle the user can be prevented.

Figure 11:
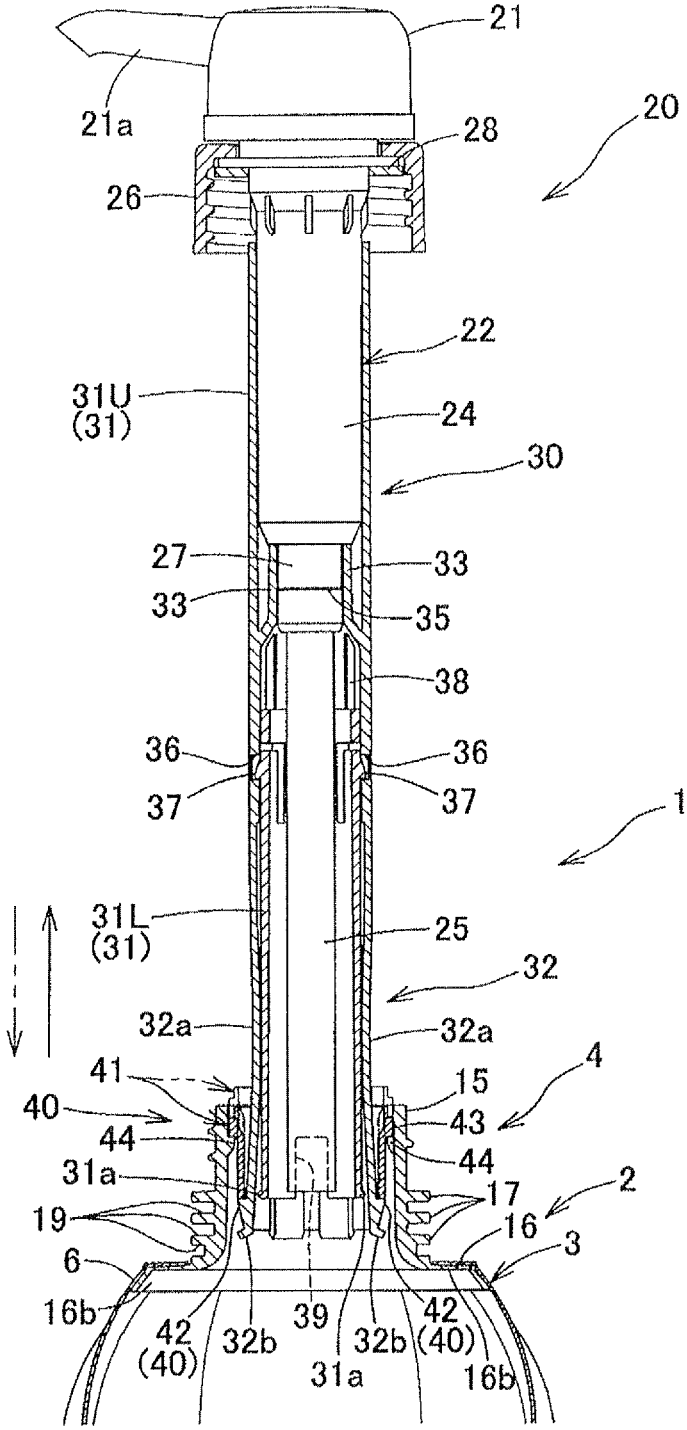
FIG. 11 is an explanatory view showing the state immediately after the attachment of the dispenser pump to the container body begins and immediately before the removal of the dispenser pump from the container body is completed.
Figure 12:
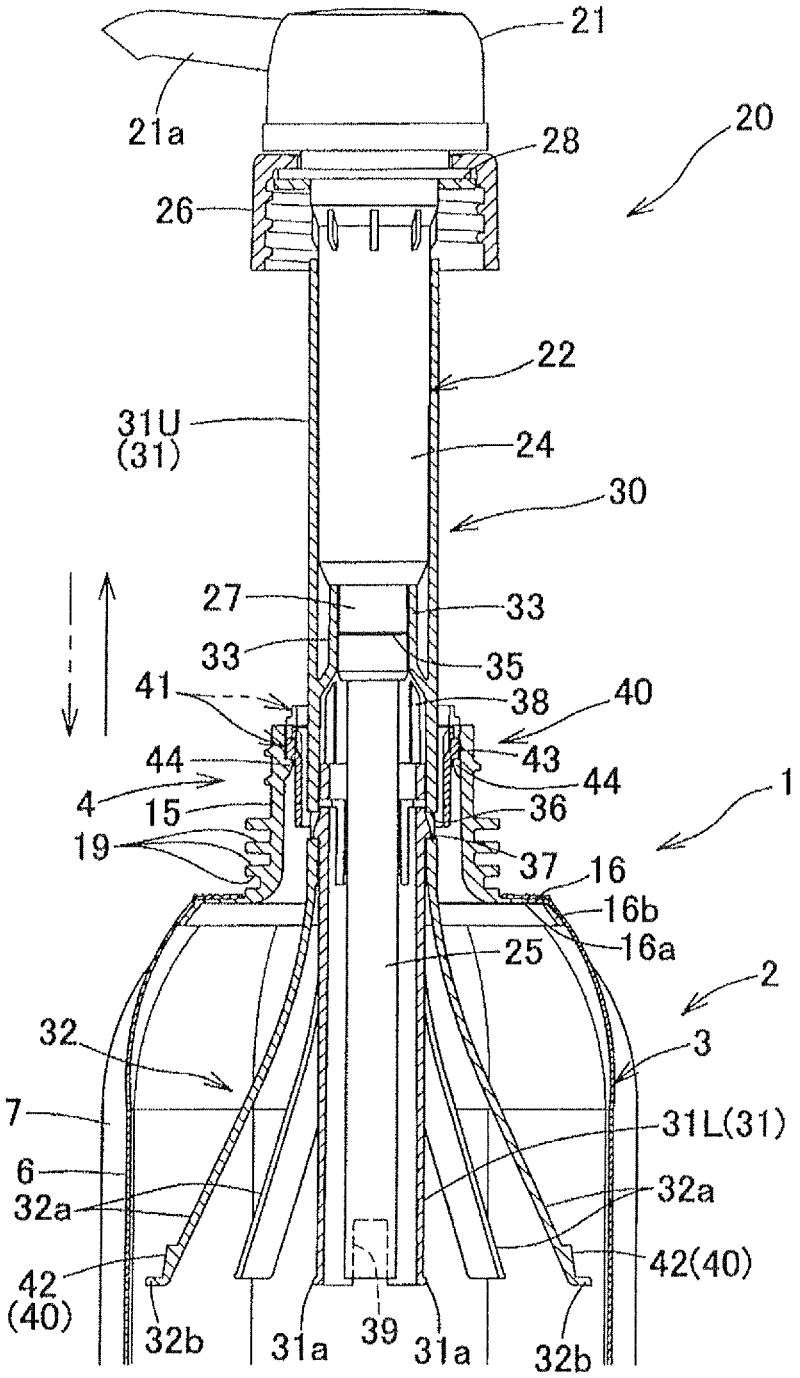
FIG. 12 is an explanatory view in the midway through the attachment and removal of the dispenser pump to and from the container body.
Figure 13:
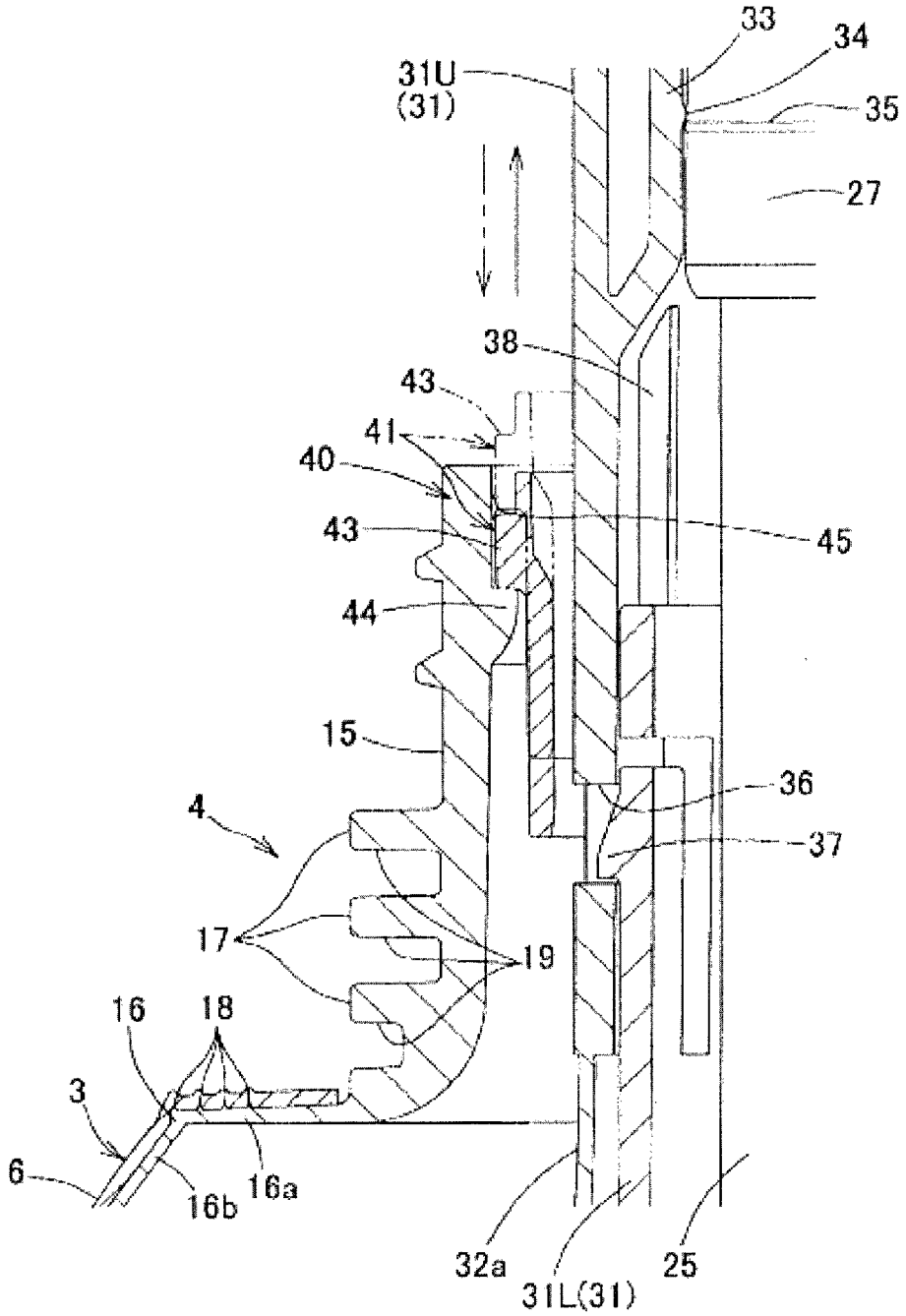
FIG. 13 is a substantial part enlarged explanatory view in the midway through the attachment and removal of the dispenser pump to and from the container body.

With the pump-equipped container 1, when the dispenser pump 20 is to be attached to the container body 2, as shown in FIG. 10, in the state where the narrowing ring 41 is shifted to the lowermost position and the plurality of leg portions 32*a* are elastically deformed in the closed-leg attitude, the bottom end portions of the leg portions 32*a* are inserted into the mouth portion 15 of the container body 2, and the dispenser pump 20 is attached to the container body 2. Then, when the bottom end portions of the leg portions 32*a* are inserted in the mouth portion 15 in this manner, as indicated by phantom lines in FIGS. 11 and 13, in the state where the bottom end portion of the collar portion 43 of the narrowing ring 41 abuts on the holding projecting portion 45, as shown in FIG. 12, the dispenser pump 20 is inserted into the container body 2, and the leg portions 32*a* elastically return to the open-leg attitude. Thus, since the dispenser pump 20 is fixed to the container body 2 after the dispenser pump 20 is inserted into the container body 2, when the lid 26 is screwed with the mouth portion 15, as indicated by solid lines in FIG. 9, the narrowing ring 41 rides over the holding projecting portions 45 and is engagingly stopped by the engaging stopper projecting portions 44. Thus, the dispenser pump 20 is attached to the container body 2.

On the other hand, when the content of the container body 2 is finished up, the dispenser pump 20 is removed from the container body 2, and the dispenser pump 20 is attached to the new container body 2 filled with the content. Specifically, in order to firstly remove the dispenser pump 20, the lid 26 is loosened so as to pull out the dispenser pump 20. At this time, since the narrowing ring 41 is held in the mouth portion 15 by the holding projecting portions 45, as shown by solid lines in FIGS. 12 and 13, in the state where the narrowing ring 41 is remaining in the mouth portion 15, part of the dispenser pump 20 except for the narrowing ring 41 relatively shifts upwardly. Then, as shown by solid lines in FIG. 11, the narrowing ring 41 is externally fitted to the leg portions 32*a*, whereby the leg portions 32*a* are switched to the closed-leg attitude. Then, as shown in FIG. 10, in the state where the restricting projecting portions 42 of the leg portions 32*a* engage with the narrowing ring 41 and the leg portions 32*a* are maintained in the closed-leg attitude, when the dispenser pump 20 is shifted further upwardly, the narrowing ring 41 shifts upwardly to ride over the holding projecting portion 45. Thus, the dispenser pump 20 can be removed from the container body 2 from which the content is finished up. Next, the dispenser pump 20 removed from the empty container body 2 is attached to the container body 2 filled with the content. Here, since the leg portions 32*a* are maintained in the closed-leg attitude by the narrowing ring 41, the dispenser pump 20 in the closed-leg attitude can be inserted as it is into container body 2 in the above-described manner. Thus, the dispenser pump 20 can be attached to the new container body 2.

Further, with the pump-equipped container 1, as shown in FIG. 9, the content is dispensed by the operation portion 21 being pushed down. Here, by the bottom end portion of the support member 31 and the bottom end portion of the leg member 32 abutting on the bottom portion 5 of the container body 2, the push-down operation force of the operation portion 21 is received by the support member 31 and the leg member 32, and acts on the container body 2 very little. Thus, with the pump-equipped container 1, the push-down operation force of the operation portion 21 is received by the support member 31 and the leg member 32. Therefore, in both cases where the operation portion 21 is pushed down in the vertical direction and where the operation portion 21 is diagonally pushed down, the push-down operation force of the operation portion 21 can effectively be received. It is to be noted that, when the operation portion 21 is pushed down, the push-down operation force of the operation portion 21 may be received solely by the support member 31, or may be received by cooperation of the support member 31 and the leg member 32. Further, in the case where the operation portion 21 is diagonally pushed down, the push-down operation force of the operation portion 21 is received by cooperation of the operation portion 21 and the leg member 32.

In this manner, with the pump-equipped container 1, since the push-down operation force of the operation portion 21 is received by the support member 31 and the leg member 32, it becomes possible to employ the container body 2 which is thinner and softer than a conventional container body. Also, the materials of the container body 2 can be reduced as much as possible. Further, even in the case where it is structured such that the refill content is replaced together with the container body 2 in order to eliminate the content refill work through use of a pouch, the waste attributed to such a disposable container body 2 can be minimized. Further, since the container body 2 can be crushed, a reduction in waste volume can also be achieved.

In the foregoing, though a description has been given of the embodiment of the present invention, the present invention is not limited to the embodiment described above, and it goes without saying that the structure thereof can be modified within the range not departing from the gist of the present invention.

REFERENCE SIGNS LIST

1 Pump-equipped container
2 Container body
3 Barrel portion
4 Mouth member
5 Bottom portion
6 Side-face sheet
7 Joining portion
8 Barrel portion valley side folding line
9 Barrel portion mountain side folding line
10 Bottom face portion
11 Joining portion
12 Bottom portion mountain side folding line
13 Bottom portion valley side folding line
15 Mouth portion
16 Shoulder portion
16*a* Flange portion
16*b* Skirt portion
17 Flange portion
18 Seal portion
19 Annular gap
4A Mouth member
16A Shoulder portion
16Aa Flange portion
16Ab Skirt portion
4B Mouth member
16B Shoulder portion
16Ba Flange portion
16Bb Skirt portion
17A Flange portion
20 Dispenser pump
21 Operation portion
21*a* Nozzle
22 Pump body
23 Stem
24 Cylinder
25 Suction pipe
26 Lid
27 Attachment portion
28 Seal ring
30 Support means
31 Support member
31*a* Receiving projecting portion
31L Bottom support member
31U Top support member
32 Leg member
32*a* Leg portion
32*b* Abutment portion
32*c* Pop-up suppressing portion
32*d* Rib portion
33 Top engaging stopper nail
34 Engaging projection
35 Engaging stopper projection
36 Engaging hole
37 Bottom engaging stopper nail
38 Engaging stopper rib
39 Cut out portion
40 Switching means
41 Narrowing ring
42 Restricting projecting portion
43 Collar portion
44 Engaging stopper projecting portion
45 Holding projecting portion

The invention claimed is:

1. A pump-equipped container, comprising:

a container body having a mouth portion; and a dispenser pump removably attached to the mouth portion, wherein the dispenser pump includes:

a pump body that has an operation portion capable of reciprocating in a top-bottom direction and that is removably attached to the mouth portion of the container body;

a support member having a bottom end portion thereof abutted on a bottom portion of the container body to thereby receive a downward load acting on the mouth portion of the container body;

a leg member provided at the support member so as to be capable of switching between a closed-leg attitude in which the leg member can pass through the mouth portion and an open-leg attitude in which the leg member spreads outwardly in a radial direction of the support member, the leg member in the open-leg attitude abutting on the bottom portion of the container body to thereby receive a diagonally downward load acting on the mouth portion of the container body; and a narrowing ring shiftable along the support member, wherein an operation of the narrowing ring can switch the leg portions between the open-leg attitude and the closed-leg attitude, wherein the leg member is a plurality of leg portions that can elastically deform over the open-leg attitude being a natural state in which the leg portions extend diagonally downwardly from an intermediate portion in a height direction of the support member and the closed-leg attitude in which the leg portions extend along the support member.

2. The pump-equipped container according to claim 1, further comprising:

an engaging stopper projecting portion that engagingly stops shifting of the narrowing ring from the mouth portion into the container body, the engaging stopper projecting portion being formed at the mouth portion of the container body.

3. The pump-equipped container according to claim 1, further comprising:

a restricting projecting portion that restricts a lowermost position of the narrowing ring relative to the support member, the restricting projecting portion being formed at each of the leg portions.

4. The pump-equipped container according to claim 3, further comprising:

a receiving projecting portion provided to at least one of the support member and the leg portions, the receiving projecting portion abutting on other one of the support member and the leg portions to receive elastic deformation of the leg portions toward the support member than the closed-leg attitude, and the receiving projecting portion being formed so as to correspond to a height position of the restricting projecting portion in the closed-leg attitude.

5. The pump-equipped container according to claim 3, further comprising:

a pop-up suppressing portion that suppresses the narrowing ring maintained at the lowermost position from popping up, the pop-up suppressing portion being formed projectively outwardly at an intermediate portion in a height direction of each of the leg portions.

6. The pump-equipped container according to claim 3, further comprising:

a holding projecting portion that holds the narrowing ring in the mouth portion of the container body, the holding projecting portion being formed at the mouth portion of the container body.

* * * * *